United States Patent [19]

Marquardt

[11] 3,959,849

[45] June 1, 1976

[54] ROLLER ASSEMBLY FOR SLIDING DOORS

[75] Inventor: Robert J. Marquardt, Miami, Fla.

[73] Assignee: Miller Industries, Inc., Miami, Fla.

[22] Filed: Aug. 8, 1975

[21] Appl. No.: 602,972

[52] U.S. Cl. ..... 16/105; 16/106; 49/420

[51] Int. Cl.[2] ..... E05D 13/02

[58] Field of Search ..... 16/97, 105, 106; 49/420

[56] References Cited

UNITED STATES PATENTS 3,416,183 12/1968 Martin ..... 16/105

*Primary Examiner*—Werner H. Schroeder
*Assistant Examiner*—Moshe I. Cohen
*Attorney, Agent, or Firm*—Salvatore G. Militana

[57] ABSTRACT

A roller assembly for sliding doors having a pair of housings one within the other with a coil spring yieldingly urging the inner housing in a direction away from the outer housing, the inner housing supporting a wheel that extends beyond the housing. Tabs are struck on the side walls of the outer housing limiting the outer movement of the inner housing and for the securing of the assembly in a sliding door frame.

3 Claims, 5 Drawing Figures

ROLLER ASSEMBLY FOR SLIDING DOORS

BACKGROUND OF THE INVENTION

1. Field of the Invention

My invention relates generally to roller assemblies and is more particularly directed to those utilized in sliding doors and the like.

2. Description of the Prior Art

There are generally two types of roller assemblies for sliding doors. One type consists of a roller extending laterally from its support member whereby the roller swings rather than slides against a spring force. These devices are complicated in construction, difficult to mount in a sliding door frame and are not as effective as the second type since the spring, whether it be a coil spring or a leaf spring, must be rather stiff in order to support the weight of the door properly.

The second type of roller assemblies for sliding doors is similar to applicant's device which provides a roller which slides longitudinally of the support member with a coil spring interposed between the roller support and the mounting of the device on the door frame. However, none of the conventional devices have a pair of housings that are slidably mounted on each other in telescopic arrangement with a spring interposed between the housings. Also, none of these devices has a means for maintaining the spring and roller in a retracted position so as to facilitate the mounting of the assembly in the door frame after which the roller support is readily released to permit the spring force to be effective in supporting the door.

SUMMARY OF THE INVENTION

Therefore, a principal object of the present invention is to provide a roller assembly which is readily mounted on the conventional frame of a sliding door and as readily attached thereto without the use of special tools and with other than the need of a skilled workman.

Another object of the present invention is to provide a roller assembly for sliding doors that is mounted thereon in a retracted position and upon threading an adjusting bolt thereon, the roller is released and the coil spring then exerts its yielding forces thereon to maintain the door is spaced relation from the door frame.

A further object of the present invention is to provide a roller assembly for sliding doors having a pair of housings or support members telescopically mounted upon each other with a coil spring interposed therebetween for yieldingly forcing the rollers in contact relation with the rail on which they are rotatably mounted.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFERRED EMBODIMENT

Figure 1:
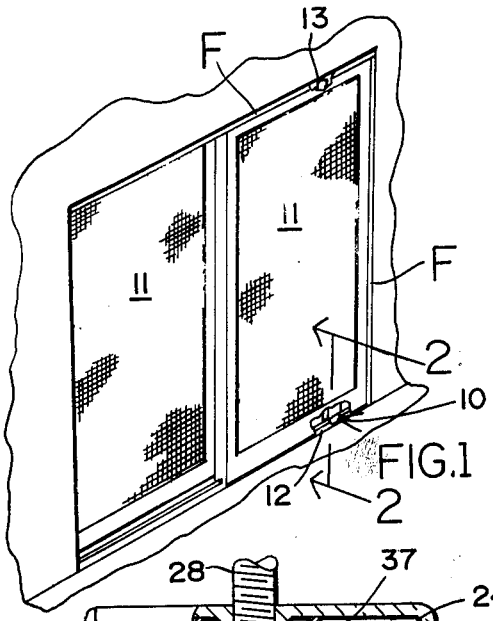
FIG. 1 is a perspective view of a sliding door shown partially broken away equipped with my roller assemblies.
Figure 4:
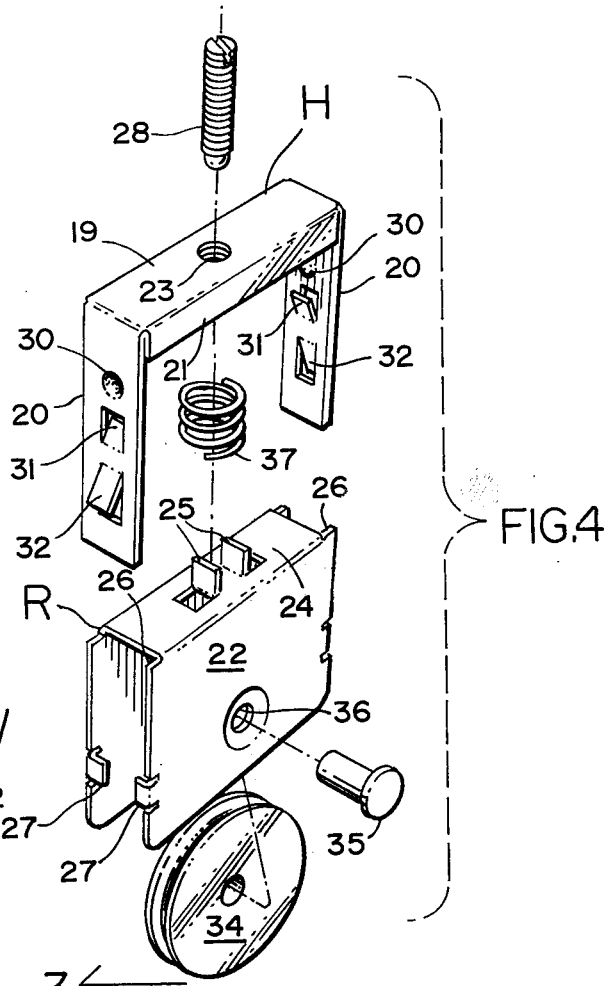
FIG. 4 is an exploded view of my roller assembly.

Referring to the drawings wherein like numerals are used to designate similar parts throughout the several views, the numeral 10 refers to a roller assembly constructed in accordance with my invention shown mounted in sliding doors 11. The sliding doors 11 are slidably mounted between upper and lower rails 13 and 12 respectively against which the roller assemblies 10 are rotatably mounted for sliding the doors 11 from their open to their closed positions and vice versa. On each sliding door 11 there are two roller assemblies 10 engaging the lower rail 12 and two roller assemblies 10 engaging the upper rail 13, the roller assemblies 10 being positioned adjacent the corners of the sliding doors 11. The frame —F— which is extruded and conventional in construction consists of side walls 14, a bottom wall 16 and a screen retainer 18 mounted on the top portion thereof.

The roller assemblies 10 which are mounted on the door frame —F— are received between the side walls 14 of the frame. The roller assemblies 10 are received in a slot 15 formed in the bottom wall 16 of the door frame —E— on which an extruded member 17 for self tapping screws (not shown) is mounted and used to secure the frame members at the corners thereof.

The roller assemblies 10 consists of an outer U-shaped housing —H— having a top wall 19 with side walls 20 extending downwardly therefrom. The side edges of the top wall 19 is provided with downturned flange portions 21 for added rigidity to the housing —H—. In the center portion of the top wall 19 there is a threaded bore 23 for receiving a screw bolt 28. Each of the side walls 20 are provided with an inwardly extending dimple 30, an inwardly extending tab 31 positioned below the dimple 30 and an outwardly extending tab 32 positioned adjacent to the lower edge portion of the side walls 20. The function of the dimple 30, and tabs 31 and 32 is explained in detail hereinafter.

Within the outer housing —H— is a slidably mounted roller containing housing —R— having a top wall 24 from which extend a front and rear wall 22. A pair of spaced and upwardly extending tab members 25 are struck from the top wall 24. The end edge portions of the top wall 24 are foreshortened to form a slot 26 for receiving the side walls 20 of the outer housing —H— as explained in greater detail hereinafter. Further tabs 27 are struck from the front and rear walls 22 and bent toward each other to contain the side walls 20 within the slots 26. At the mid-portion of the front and rear walls 22 is an enlarged dimple extending inwardly toward each other to form a bearing for a grooved wheel 34 rotatably mounted therebetween on a pin 35 extending through an opening 36 in the front and rear walls 22. Extending between the housings —H— and —R— is a coil spring 37 extending between the top walls 19 and 24 yieldingly urging the housing —R— outwardly of the housing —H— to its furthest position at which the tabs 31 of the housing —H— will engage the top wall 24 of the housing —R—. In the normal shipping or non-use position, the housing —R— will be placed at its innermost position at which the dimples 30 will engage the inner surface of the top wall 24 and remain at this position until the screw bolt 28 has been threaded inwardly to engage the top wall 24 at the position of the upwardly extending tabs 25 and force the inner housing —R— to slide past the dimples 30.

Figure 5:
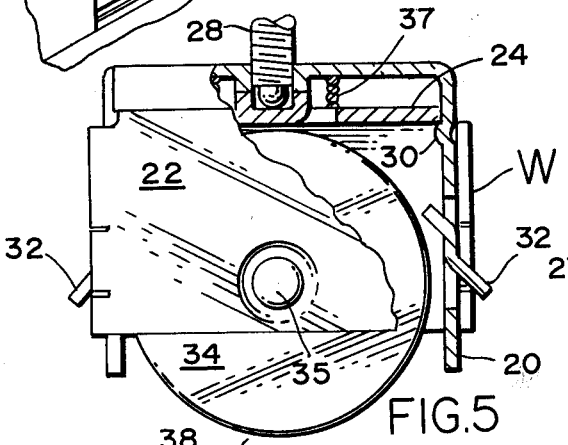
FIG. 5 is a side view of my roller assembly partially broken away prior to mounting on the sliding door.
Figure 3:
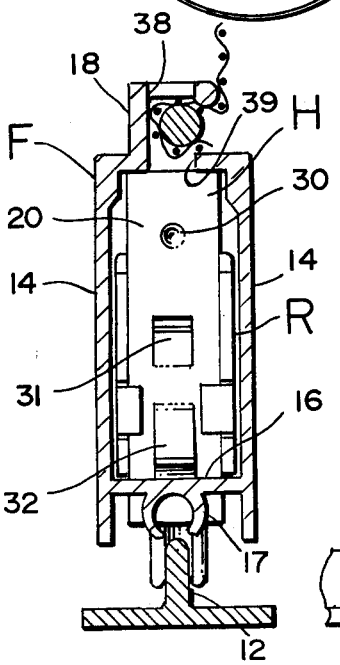
FIG. 3 is a cross sectional view taken along the line 3—3 of FIG. 2.
Figure 2:
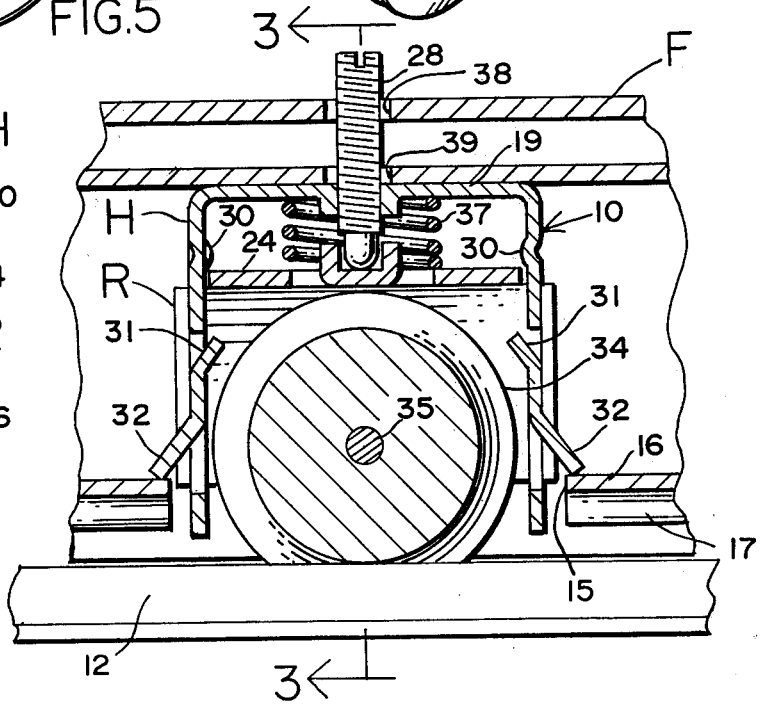
FIG. 2 is a cross sectional view taken along the line 2—2 of FIG. 1.

In the normal erection of conventional sliding doors 11 when utilizing my roller assemblies 10, all that need be done is punch four slots 15 in the wall 16 of the door frame —F— and drill bores 38 and 39 through the screen retaining members 18. With the outer and roller housings —H— and —R— positioned as shown by FIG. 5, the roller assembly 10 is inserted through the slot 15 of the door frame —F— and forced inwardly until the top wall 19 of the outer housing —H— engages the top wall of the extruded frame member —F— and the tabs 32 engage the bottom wall 16 as shown by FIG. 2. The roller assemblies 10 are now securely positioned in the frame member —F—, with the roller 34 within the confines of the door frame member —F—. The sliding door 11 is then placed in position between the rails 12 and 13. Since the rollers 34 of the four roller assemblies 10 mounted on the sliding door 11 are in their retracted position, the door 11 will fit readily therebetween. Now, the screw bolt of the two lower roller assemblies 10 are threaded downwardly. The inner housings —R— will slide outwardly of the outer housing —H— past the dimples 30 until the rollers 34 are at the desired distance beyond the frame —F— engaging the rail 12 with a sufficient clearance between the frame member —F— and the floor on which the rail 12 is mounted. At this time, the screw bolts 28 of the two upper roller housings 10 are threaded in the direction of the roller housing —R— has passed over the dimples 30. The housing —R— will now slide outwardly of the outer housing —H— under the influence of the coil spring 37 to cause the rollers 34 to engage the upper rail 13. The sliding door 11 is now properly erected and will slide readily along the rails 12 and 13.

Whenever it is necessary to remove the sliding door 11 from the door frame, all that need be done is grasp the door 11 and force it upwardly against the spring pressure of the two upper roller assemblies 10. When the door is slid upwardly sufficiently to effect the clearance of the two lower rollers 34 above the lower rail 12, the door 11 is tilted to swing the lower part of the door toward the person tilting the door and then dropping the door 11 to remove the upper rollers 34 from the upper rail.

To replace the door 11 on the rails, the upper part of the door 11 is tilted toward the upper rail 13 and the upper rollers 34 are placed against the upper rail. The door 11 is now forced upwardly to cause the springs 37 of the upper roller assemblies to be compressed until the rollers 34 of the lower assemblies clear the lower rail 12, after which the lower part of the door 11 is swung inwardly until the lower rollers 34 are in alignment with the lower rail 12. Then the door 11 is released and the springs 37 of the upper roller assemblies 10 will cause the door 11 to shift downwardly and the lower rollers 34 to engage the lower rail 12.

What I claim as new and desire to secure by Letters Patent is:

1. A roller assembly for sliding doors comprising a roller support member having a top wall and side walls in spaced relation to each other, a roller rotatably mounted between said side walls, a further support member, means telescopically mounting said further support member on said roller support member, spring means mounted between said members yieldingly urging said roller support member outwardly of said further support member, means mounted on said further support member frictionally engaging said roller support member and restraining the outward movement of said roller support member, a threaded bore mounted on said further support member and a threaded member mounted in said threaded bore engaging said roller support member whereby upon the threading of said threaded member in the direction of said support member, said roller support member is compelled to slide past said restraining means, and said spring means effecting an outward sliding movement of said roller support member.

2. The structure as recited by claim 1 taken in combination with shoulder means mounted on said further support member preventing the outward movement of said roller support member beyond a desired position.

3. The structure as recited by claim 2 taken in combination with further shoulder means mounted on said further support member for securing said roller assembly in said sliding door.

* * * * *